United States Patent [19]

Fukazawa

[11] 4,040,519

[45] Aug. 9, 1977

[54] FROTH FLOTATION PROCESS FOR RECOVERING SHEELITE

[75] Inventor: Koji Fukazawa, Iwaki, Japan

[73] Assignee: Nittetsu Mining Company, Ltd., Tokyo, Japan

[21] Appl. No.: 551,239

[22] Filed: Feb. 20, 1975

[30] Foreign Application Priority Data

Mar. 28, 1974 Japan ..... 49-33927
Mar. 28, 1974 Japan ..... 49-33928

[51] Int. Cl.[2] ..... B03D 1/14

[52] U.S. Cl. ..... 209/166; 423/53; 423/167; 423/319

[58] Field of Search ..... 209/166, 167; 423/53, 423/155, 167, 319

[56] References Cited

U.S. PATENT DOCUMENTS

| | | | |
|---|---|---|---|
| 1,081,566 | 12/1913 | Becket | 423/53 |
| 1,410,584 | 3/1922 | Lubowsky | 423/53 |
| 1,906,386 | 5/1933 | Liljenroth | 423/167 |
| 1,986,816 | 1/1935 | Hasselstrom | 209/166 |
| 2,120,485 | 6/1938 | Clemmer | 209/167 |
| 2,373,305 | 4/1945 | Gieseke | 209/166 |
| 2,442,455 | 6/1948 | Booth | 209/166 |
| 2,741,364 | 4/1956 | Wilson | 209/166 X |
| 2,861,687 | 11/1958 | Lord | 209/166 X |
| 3,338,674 | 8/1967 | Baniel | 423/167 X |
| 3,454,159 | 7/1969 | Hollingsworth | 209/3 |
| 3,528,784 | 9/1970 | Green | 209/167 X |
| 3,635,337 | 1/1972 | Mercade | 209/3 |
| 3,915,391 | 10/1975 | Mercade | 209/5 |

*Primary Examiner*—Bernard Nozick
*Assistant Examiner*—Frank Sever
*Attorney, Agent, or Firm*—Oblon, Fisher, Spivak, McClelland & Maier

[57] ABSTRACT

This invention relates to a froth flotation process for recovering scheelite from scheelite ores. This invention comprises adding a sulphonate collector or a mixture of a sulphonate collector and a fatty acid collector to a pulp containing the ores, selectively floating the scheelite from the ores and recovering the flotation concentrate thus obtained.

6 Claims, 4 Drawing Figures

FROTH FLOTATION PROCESS FOR RECOVERING SHEELITE

This invention relates to an improved froth flotation process for recovering scheelite from scheelite ores.

Scheelite ores normally contain gangue such as pyroxen, garnet, quartz and calcite, sulfide minerals and the like other than scheelite.

The process for recovering scheelite from scheelite ores has been mainly carried out by a primitive gravity concentration and a flotation separation has been merely carried out as a supplementary method like a magnetic or electrostatic separation method, because in the scheelite flotation scheelite can not be separated sufficiently from gangue by using a fatty acid collector such as oleic acid, which has been widely used and especially it is difficult to separate scheelite from calcite, since the floatability of scheelite is resemble closely to that of calcite. Therefore, in prior arts, the gangue such as calcite has been previously separated as much as possible by a gravity concentration. However, it is not economical to recover the scheelite concentrate from scheelite ores of low grade or of fine size by the gravity concentration.

An object of the present invention is to provide a process for recovering scheelite not only from common scheelite ores, but from the gangue containing calcite with small amount of scheelite.

Another object of the present invention is to provide a process for recovering a scheelite of high grade with high recovery.

Still another object of the present invention is to provide an economical method for recovering scheelite.

The other objects and advantages of the present invention will become more apparent from the following description and drawings.

Figure 1:
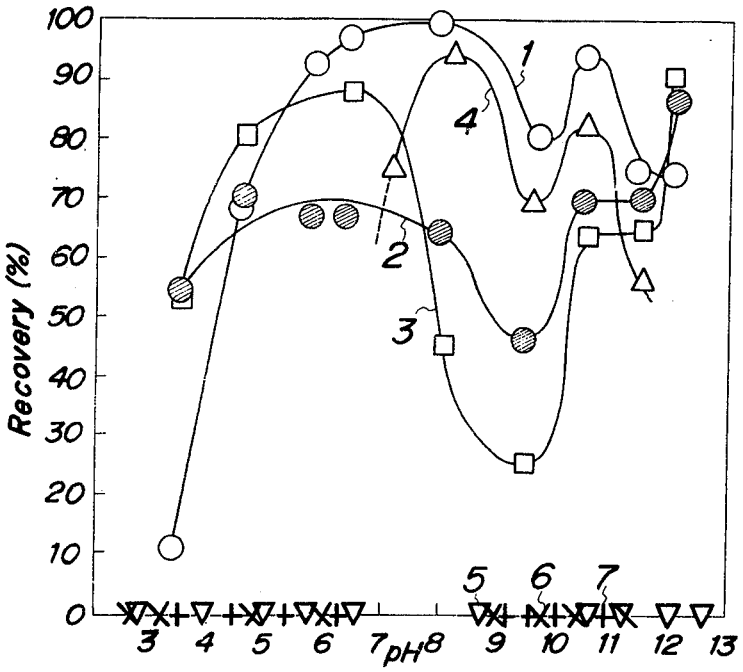
Figure 2:
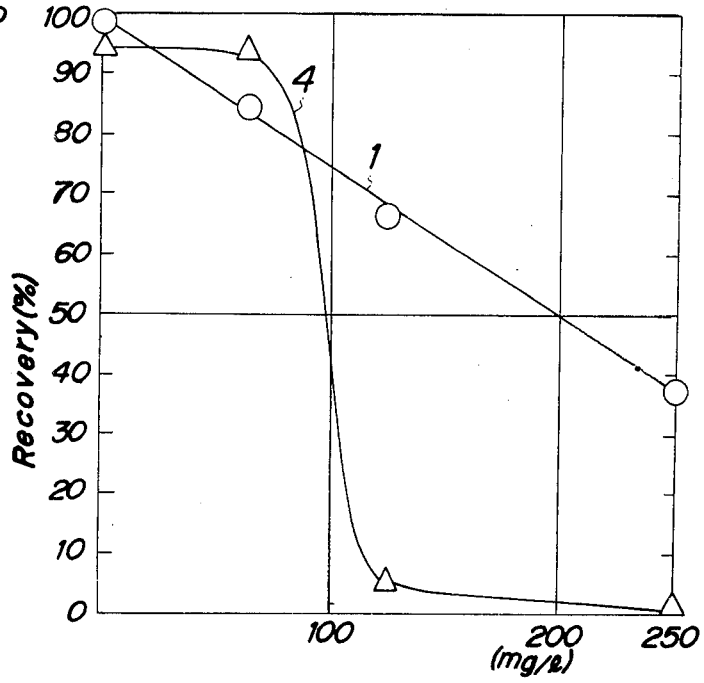

FIG. 1 and FIG. 2 show the results which were obtained by a froth flotation test of minerals consisting of scheelite, calcite, skarn mineral and the like, respectively, and FIG. 1 shows the relation between pH of pulp and their recovery and FIG. 2 shows the relation between an amount of sodium silicate and the recovery of scheelite or calcite.

Figure 4:
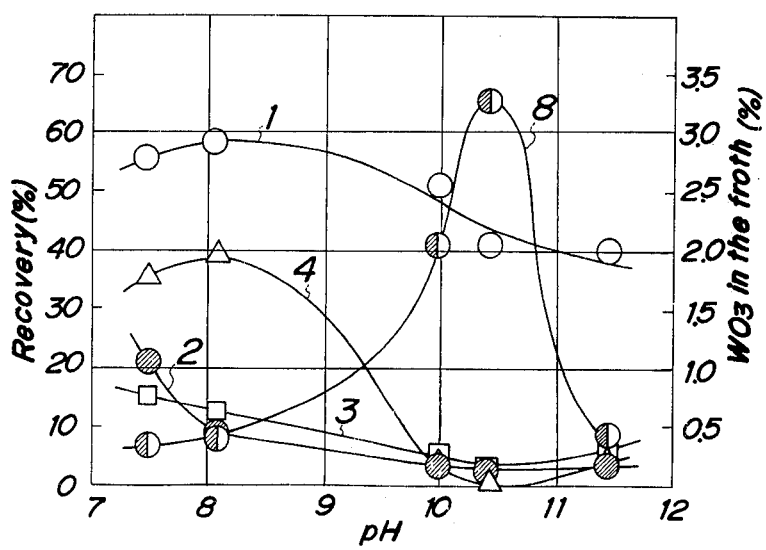
Figure 3:
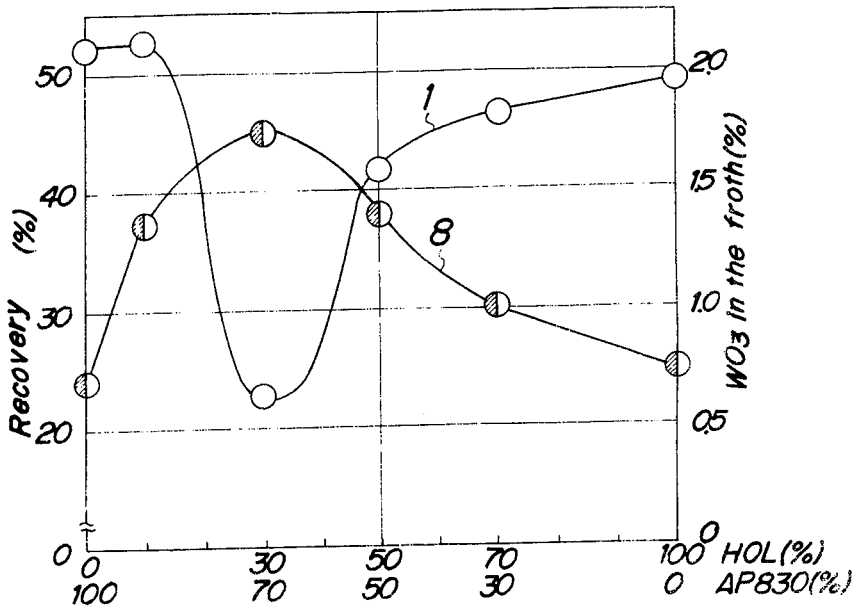

FIG. 3 and FIG. 4 show the results of froth flotation process of low grade ores in $WO_3$ content in which AP 830 (trade mark of American Cyanamide Co., Ltd.) and oleic acid were used as collectors and AF 65 (trade mark of American Cyanamide Co., Ltd.) was used as a frother. FIG. 3 shows the relation between the mixing ratio of AP 830 and oleic acid and the $WO_3$ recovery or $WO_3$ content of the froth and FIG. 4 shows the relation of pH of slurry and the $WO_3$ recovery or $WO_3$ content of the minerals.

Froth flotation of scheelite, calcite and skarn mineral and the like, respectively, was carried out at the following conditions:

| | | |
|---|---|---|
| Pulp density | 10% solid | |
| Collector | AP 830 | 12 mg/l |
| Frother | AF 65 | 5 mg/l |

The results of the above experiments are shown in FIG. 1. Numeral 1, 2, 3, 4, 5, 6 and 7 in FIG. 1 indicate scheelite, chalcopyrite, pyrrhotite, calcite, andradite, hedenbergite and slate, respectively.

It can be estimated from FIG. 1 that hedenbergite 6, andradite 5 and slate 7 are able to be separated from sheelite 1 in wide pH range of 5 – 11, but the separation of scheelite 1 and calcite 4 is difficult by froth flotation in the pH range.

Froth flotation of scheelite 1 and calcite 4, respectively, was carried out by conditioning them with sodium silicate (28 – 30% $SiO_2$ and 9 – 10% $Na_2O$), and adding AP 830 as a collector and AF 65 as a frother. The results of the above experiments are shown in FIG. 2.

It can be estimated that the separation of scheelite 1 and calcite 4 is carried out effectively in the case adding 120 mg/1 of sodium silicate.

Further, after a fine scheelite ore ($WO_3$ 0.022%, Cu 0.041%, S 0.22%, $CaCO_3$ 6.24%) was conditioned in pulp density of 38% solids by weight by adding 600 g/t-ores of sodium silicate ($SiO_2$ 28% and $Na_2O$ 9%), froth flotation was carried out by adding 20 g/t-ores of sodium hydroxide, 80 g/t-ores of total amount of AP 830 and oleic acid and 30 g/t-ores of AF 65, while pH was maintained at 10.2 – 10.3 and temperature of the pulp at 18° – 20° C. The results of the experiments are shown in FIG. 3. In FIG. 3, numeral 8 indicates $WO_3$ % in the froth and HOL indicates oleic acid.

It becomes clear from FIG. 3 that the mixing ratio of AP 830 and oleic acid has important effects upon the froth flotation between scheelite and calcite and the selectively of the minerals is remarkable at the mixing ratio of 40 – 60 : 60 – 40, preferably 1 : 1.

After a fine scheelite ore (0.035% $WO_3$, 0.035% Cu, 0.13% S and 7.64% $CaCO_3$) was conditioned at pulp density of 38% solids by weight by adding 600g/t-ores of sodium silicate ($SiO_2$ 28% and $Na_2O$ 9%), froth flotation was carried out by adding 20g/t-ores of sodium hydroxide, 80g/t-ores or total amount of the AP 830 and oleic acid at the ratio of 1 : 1, while pH was maintained at various values and temperature of the pulp at 18 – 20 ° C. The results of the experiments are shown in FIG. 4.

It becomes clear from FIG. 4 that the pH range of 9.8 – 10.7 has good effects upon the froth flotation.

The present invention provides a process for recovering scheelite from scheelite ores by froth flotation which comprises adding a sulphonate collector or a mixture of a sulphonate collector and a fatty acid collector to a pulp of the ores which are or are not conditioned with sodium silicate and selectively floating the scheelite from the ores and recovering the flotation concentration thus obtained.

It is preferable to use a mixture of a sulphonate collector and a fatty acid collector. However, when the content of calcite is lower than a half of the content of scheelite in the scheelite ores, it is not necessarily required to condition the ores with sodium silicate and a relatively high grade scheelite concentrate can be recovered in good yield by froth flotation using only a sulphonate collector; and when the content of calcite is higher than a half of the content of scheelite in the scheelite ores, a relatively high grade scheelite concentrate can be recovered in good recovery by froth flotation with the addition of a sulphonate collector after conditioning the ores with sodium silicate. However, when the content of calcite is considerably more than that of scheelite in scheelite ores, it is preferable to float with the addition of a mixture of a sulphonate collector and a fatty acid collector after conditioning the ores with sodium silicate.

The average range of pulp density at the froth flotation is in practice preferably 25 – 45% solids. 300–1000 g/l of sodium silicate containing 30 – 36% $SiO_2$ and 9 – 15% $Na_2O$ is preferably added to the pulp as a depressant. It is preferable to added the sodium silicate and then to condition for 2 – 3 minutes before addition of a collector to increase the depressing effects.

In the present invention, various sulphonate collectors may be used and AP 830 is especially preferable among them. Oleic acid and linolic acid are preferably used as a fatty acid collector. The collector is used at the quantity of 40 – 200 g/t-ores.

It is preferable to carry out froth flotation soon after the addition of the collector, because sodium silicate can not perfectly depress the floating of gangues such as calcite and the like, but may retard the reaction between the collector and the gangue and delay the floatation rate of the gangue and the depressing effect of sodium silicate decreases with an increase of the conditioning time. Therefore, stage addition of a collector is preferable when flotation takes a long time.

Mixing ratios of a sulphonate collector and a fatty acid collector are 60 – 40 : 40 – 60, preferably 1 : 1 by weight.

When the scheelite ores do not contain minerals such as calcite and the like having similar floatability to scheelite in the embodiment of the present invention, the scheelite may be satisfactorily recovered at pH of 5 – 11 as apparently shown in FIG. 1. However, when the scheelite ores contain minerals such as calcite and the like, and the minerals are depressed by conditioning with dosium silicate, the scheelite may be recovered at the pH of 9.8 – 10.7.

In addition to the collector and the depressant, a frother such as pine oil, AF 65 and a secondary depressant containing tannic acid such as Quebracho C and Quebrachol D (trade mark of Nippon Perfume Chemical Co., Ltd.) may be used, if necessary, in the embodiment of the present invention.

It is preferable to eliminate fine particles of calcite (under 15 – 20 micron) by preliminary treatment such as classification prior to the froth flotation, in order to separate scheelite effectively from calcite.

In the present invention, froth flotation is usually carried out at a normal temperature. When the froth flotation is carried out at above 20 ° C, it is necessary to increase the amount of a depressant such as sodium silicate to carry out effectively the separation between scheelite and calcite, since the amount of calcite in the froth of scheelite tends to increase suddenly. On the other hand, when the froth flotation is carried out at below 20 ° C, it is necessary to increase the amount of a collector, since the amount of floatable scheelite decreases.

The high-grade scheelite concentrate can be recovered by carrying out repeatedly the froth flotation for the scheelite concentrate. However, the amount of silicate minerals, carbonate minerals, apatite and sulfide minerals, which are originally present in scheelite ores, accumulate little by little by the repetition of the cleaning 1 flotation and therefore, the up-grading of $WO_3$ in scheelite concentrate is prevented and components such as Cu, S, P, As and the like which are injurious for the manufacture of the scheelite product increase in the scheelite concentrate. Such a phenomenon appear remarkably when the scheelite ores is low grade.

A possible reason for the increase of the above injurious minerals may reside in that the collector absorbed on the surface of the low grade scheelite concentrate can not be desorbed by adding a depressant as the collector is absorbed rigidly.

It was found by my study that these defects are dissolved by the following process:

1. A case of a low grade scheelite concentrate which contains carbonate minerals and/or apatite: The concentrate is treated with hydrochloric acid to dissolve the soluble substances and then treating the resultant concentrate with alkaline substances, 2. A case of a low grade scheelite concentrate which does not contain carbonate minerals and apatite: The concentrate is treated with alkaline substances.

Accordingly, it was found that high grade scheelite concentrate was recovered from the low grade scheelite concentrate treated with the above processes by froth flotation which comprises adding large amounts of a depressant such as Quebracho C and D for sulfide minerals and silicate minerals and small amounts of a fatty acid collector such as oleic acid to the pulp of the resultant scheelite concentrate after filtration, washing, dewatering and repulping.

The present invention further provides a flotation process for recovering scheelite which comprises the first step in which after the low grade scheelite concentrate rigidly adsorbed a collector is treated with hydrochloric acid, the insoluble substances are treated with alkali substances or the low grade scheelite is directly treated with the alkali substances without treating with hydrochloric acid and then the insoluble substances are filtered off and the second step in which the cake obtained in the first step is repulped and floated with the addition of a depressant and a fatty acid collector for scheelite.

In the above first step, it is preferable to use 1.1 – 1.2 times excess of the stoichiometric amount of concentric hydrochloric acid in respect to the weight of the reactive material such as carbonate minerals and apatite and to bring pH to 0.2 – 0.8 after the treatment of the low grade scheelite concentrate. It is also preferable to allow to stand for 0.5 – 3 hours to completely dissolve the apatite with hydrochloric acid, if necessary. The first step may, however, be omitted when the low grade scheelite concentrate does not contain the carbonate minerals and/or the apatite. In the above first step caustic soda is added to the pulp at the rate of 20 – 30 kg/t-ores, while bringing the pulp density to 20 – 40% solids and treating the pulp for 5 – 20 minutes after addition of caustic soda.

In the above second step, reagents containing tannic acid, sodium silicate and/or sodium sulfide are used as a depressant. It it most preferable to use Quebracho C and/or D as the reagent containing tannic acid. These reagents are added to the pulp at the rate of 20 – 40 kg/t-ores and the pulp is conditioned for 3–5 minutes thereafter. Sulfide minerals such as chalcopyrite, pyrite and pyrrhotite and gangue such as quartz and silicate minerals other than scheelite are depressed by the above treatment, but scheelite is not depressed. Therefore, scheelite can be concentrated by adjusting pH to 9.5 – 10.5 with caustic soda and adding 30 – 150 g/t-ores of a fatty acid collector such as oleic acid and 50–160 g/t-ores of a frother such as AF 65.

It is also preferable to add a starvation quantity of a collector with stage addition during flotation. High grade scheelite concentrate can be obtained in high recovery by conditioning with the addition of 5.0 kg/t-ores of Quebracho C or D to the scheelite concentrate obtained by the first froth flotation, while adding 30 –

100 g/t-ores of a fatty acid collector and 20 - 70 g/t-ores of a frother and repeating the processes for 1 - 2 times.

According to the present invention, scheelite containing 30 - 70% $WO_3$ can be recovered in recovery of over 40% from not only scheelite containing high $WO_3$ content but also waste scheelite ores containing about 0.03% $WO_3$.

Such a good achievement as the above can not be obtained in the froth flotation of the other ores and it may be possible to apply the present process to the utilization of the unused natural resources and industrial waste other than scheelite.

EXAMPLE 1

300g of ores containing scheelite (3.32% $WO_3$), andradite, hedenbergite, quartz and very small amount of calcite was pulverized to the grain size of below 149 micron, water was added to the ground ores to obtain pulp density of 30% solid, and then froth flotation of the ores was carried out at pH of 9.6 for 5 minutes with the addition of 130 g/t-ores of AP 830 and 55 g/t-ores of Nikko Pine Oil new number 5 (trade mark). After the froth was recovered, the re-flotation of the unfloated ore was carried out for 5 minutes with the addition of 65 g/t-ores of AP 830 and 27 g/t-ores of Nikko pine oil new number 5. Then, the froth flotation of the first and the second froth (the frist scheelite concentrate) was carried out at pulp density of 7% solids for 6 minutes without the addition of the flotation reagents, and the second scheelite concentrate was recovered.

The results are shown in the following table.

| | Wt. (%) | Grade $WO_3$ (%) | Distributions of $WO_3$ (%) |
|---|---|---|---|
| Head sample | 100.00 | 3.32 | 100.00 |
| 1st scheelite concentrate | 17.59 | 18.66 | 99.0 |
| 2nd scheelite concentrate | 6.73 | 47.80 | 97.01 |
| Tailing of cleaning | 10.86 | 0.61 | 1.99 |
| Tailing of roughing | 82.41 | 0.04 | 1.00 |

EXAMPLE 2

300g of ores containing scheelite ($WO_3$ 3.57%), calcite ($CaCO_3$ 10.2%), quartz, andradite, hedenbergite and the like was pulverized to the grain size of below 149 micron, water was added to the ground ores to obtain pulp density of 30% solid and then froth flotation of the ores was carried out at pH of 9.8 for 5 minutes with the addition of 130 g/t-ores of AP 830 and 55 g/t-ores of Nikko Pine Oil New No. 5 after conditioning with 400 g/t-ores of sodium silicate (35% $SiO_2$, 15% $Na_2O$) for 3 minutes. After the froth was recovered the re-flotation of the unfloated ores was carried out for 3 minutes with the addition of 65 g/t-ores of AP 830 and 27 g/t-ores of Nikko Pine Oil New No. 5.

Then, the froth flotation of the first and the second frothes (the first scheelite concentrate) was carried out at pulp density of 7% solid for 6 minutes with the addition of 200 g/t-ores of the same sodium silicate as the above and the second scheelite concentrate was recovered.

The results are shown in the following table.

| | Wt. (%) | Grade $WO_3$ (%) | Distribution of $WO_3$ (%) |
|---|---|---|---|
| Head sample | 100.00 | 3.57 | 100.00 |
| 1st scheelite concentrate | 20.21 | 16.39 | 92.85 |
| 2nd scheelite concentrate | 8.50 | 37.96 | 90.42 |
| Tailing of cleaning | 11.71 | 0.74 | 2.43 |
| Tailing of roughing | 79.79 | 0.32 | 7.15 |

EXAMPLE 3

Fine ores (grain size; 25% by weight over 105 micron, 31% below 37 micron) containing scheelite (0.031% $WO_3$), calcite, andradite, hedenbergite and quartz and the like was added with water to prepare pulp density of 38.2% solid. The pulp was feeded to the first conditioner at the rate of 21.4 t-ores/hr, conditioned for 2 minutes at ph of 10.3 with the addition of 500 g/t-ores of sodium silicate (35% $SiO_2$, 14% $Na_2O$) and 14 g/t-ores of sodium hydroxide in the conditioner. Then, the pulp was transferred to the second conditioner and conditioned for 30 seconds with the addition of 40 g/t-ores of a collector consisting AP 830 and oleic acid (mixed ratio 1 : 1) and 20 g/t-ores of AF 65 in the vessel. The roughing flotation of thus conditioned pulp was carried out by using 6 cells of the Warman No. 48 type flotator. The froth of scheelite concentrate was repeatedly cleaned 5 times by 8 cells of the FW No. 10 type flotator. Final scheelite concentrate was recovered at the fifth cleaning. The tailing of each step of the cleaning was repeatedly feeded to the preceding step and the tailing of the first cleaner was feeded to the second conditioner.

In the first cleaning 80 g/t-ores of sodium silicate (35% $SiO_2$, 14% $Na_2O$) and 16 g/t-ores of Quebracho D were added to the pulp in order to accelerate the depression of calcite and the other gangue minerals in cleaner circuit and in the fourth cleaning 2 g/t-ores of Quebracho C was added to depress sulfide minerals.

The results thus obtained are shown in the following table.

| | Amount (t/h) | (%) | Grade $WO_3$ (%) | Distribution of $WO_3$ (%) |
|---|---|---|---|---|
| Head sample | 21.4 | 100.0 | 0.031 | 100.0 |
| Concentrate | 0.0073 | 0.034 | 38.22 | 42.0 |
| Tailing | 21.3927 | 99.966 | 0.018 | 58.0 |

EXAMPLE 4

To 300g of scheelite concentrate (grain size; below 100 mesh, composition; 29.1% $WO_3$, 0.46% Cu, 5.1% S, 0.56% P and 34.5% $CaCO_3$) which was recovered by the froth flotation of ores containing scheelite with using mixed collector of AP 830 and oleic acid at the ratio of 1 : 1, water was added to prepare pulp density of 60% solid. 240g of 35% HCl (equivalent to 800 kg/t-ores) were added while agitating the pulp and then let alone for 2 hours to dissolve calcite and apatite. The pH of the pulp attained to 2. The insoluble matter was filtered off and thus obtained cake was washed with water and then dehydrated.

Then, the pulp density of 30% solid was prepared by adding water to the cake thus obtained and after the pulp added with 30 kg/t-ores of caustic soda was agitated for 10 minutes, the pulp was filtered off and the cake was washed with water and then dehydrated.

Thus obtained cake was charged in the FW type flotation testing cell of 800ml capacity and the pulp density of 19% solid was prepared by adding with water in the cell and the pulp was conditioned for 5 minutes with the addition of 25 kg/t-ores of Quebracho C.

The froth flotation of the pulp thus obtained was carried out for 7 minutes at pH of 10.2 with the addition of 350 g/t-ores of caustic soda, 729 g/t-ores of oleic acid and 100 g/t-ores of AF 65 and then scheelite concentrate was recovered.

The scheelite concentrate was once more transferred to the above flotation cell, added with water to prepare pulp density of 14% solids. The froth flotation of the pulp was carried out for 9 minutes at pH of 10.2 with the addition of 5.0 kg/t-ores of Quebracho C, 250 g/t-ores of caustic soda, 72 g/t-ores of oleic acid and 50 g/t-ores of AF 65.

The scheelite concentrate was recovered and the tailing of roughing and cleaning was used as sulfide minerals.

The results are shown in the following table.

| | Wt(%) | Grade (%) | | | Distribution (%) | | |
|---|---|---|---|---|---|---|---|
| | | $WO_3$ | Cu | S | $WO_3$ | Cu | S |
| Head sample | 100 | 29.13 | 0.46 | 5.07 | 100.00 | 100.00 | 100.00 |
| Feed to flotation | 65.0 | 44.83 | 0.71 | 7.80 | 100.00 | 100.00 | 100.00 |
| Scheelite concentrate | 44.1 | 65.46 | 0.013 | 0.079 | 99.03 | 1.21 | 0.69 |
| Sulfide minerals | 20.9 | 1.35 | 2.18 | 24.07 | 0.97 | 98.79 | 99.31 |

Note: the above scheelite concentrate contained 0.01% P and very small amount of $CaCO_3$

EXAMPLE 5

To 250g of scheelite concentrate (grain size; below 100 mesh, composition; 44.05% $WO_3$, 1.28% Cu, 3.86% S, 0.02% P, 5.80% $CaCO_3$) recovered by the froth flotation of scheelite ores with the addition of a mixed collector of Ap 830 and oleic acid (mixed ratio; 1 : 1), water was added to prepare pulp density of 30% solid and after the pulp added with 30 kg/t-ores of caustic soda was agitated for 20 minutes, the pulp was filtered off and the cake was washed with 300ml of water and then dehydrated.

Thus obtained cake was charged in the FW type flotation testing cell of 800ml capacity and the pulp density of 28% solid was prepared by adding water in the cell and the pulp was conditioned for 5 minutes with the addition of 25 kg/t-ores of Quebracho D.

The froth flotation of the pulp thus obtained was carried out for 10 minutes at pH of 10.3 with the addition of 300 g/t-ores of caustic soda, 72 g/t-ores of oleic acid and 50 g/t-ores of AF 65 and scheelite concentrate was recovered.

The scheelite concentrate was once more transfered to the above flotation cell, added water to prepare pulp density of 22% solid. The froth flotation of the pulp was carried out for 7 minutes at pH of 10.2 with the addition of 5.0 kg/t-ores of Quebracho D. 200 g/t-ores of caustic soda, 30 g/t-ores of oleic acid and 50 g/t-ores of AF 65 and scheelite concentrate was recovered and the tailing of roughing and cleaning was used as sulfide minerals.

The results are shown in the following table.

| | Wt.(%) | Grade (%) | | | Distribution (%) | | |
|---|---|---|---|---|---|---|---|
| | | $WO_3$ | Cu | S | $WO_3$ | Cu | S |
| Head sample | 100.00 | 44.05 | 1.28 | 3.86 | 100.00 | 100.00 | 100.00 |
| Scheelite concentrate | 78.31 | 53.78 | 0.26 | 0.82 | 95.60 | 15.91 | 16.64 |
| Sulfide minerals | 21.69 | 8.94 | 4.96 | 14.83 | 4.40 | 84.09 | 83.36 |

Note: The above scheelite concentrate contained 0.02% P and 6.31% $CaCO_3$.

What is claimed is:

1. A process for recovering scheelite concentrate from scheelite ores which comprises in an alkaline treatment step, treating a low grade scheelite containing concentrate obtained from said ore by initial froth flotation and containing an objectionable amount of adsorbed collector added during said initial froth flotation, which amount of adsorbed collector interferes with further stages of scheelite concentration of froth flotation, with caustic soda as an alkaline substance in an amount sufficient to substantially remove said amount of objectionable adsorbed collector, in water to form a pulp and filtering the pulp to form a cake, washing the cake with water, and repulping the cake and thereafter in a flotation step, adding 20–40 kg/t-ores in the repulped cake of quebracho as a depressant for sulfide minerals and silicate minerals to the repulped cake and conditioning the pulp for 3–5 minutes and then, following the conditioning step, floating the conditioned pulp at a pH of 9.5–10.5 with addition of 30–150 g/t-ores in the conditioned pulp of a fatty acid collector and 50–160 g/t-ores of a frother and recovering a scheelite concentrate.

2. The process of claim 1 in which a sheelite concentrate containing gangue such as carbonates, phosphates and sulfide minerals is treated with hydrochloric acid to dissolve said carbonates and phosphates and then is filtered off prior to said alkaline treatment step to form a cake which is repulped for said alkaline treatment step.

3. The process for recovering scheelite from scheelite ores according to claim 2, wherein carbonate materials, apatite and sulfide minerals in the gangue are dissolved with 1.1 – 1.2 times excess of stoichiometric amount of hydrochloric acid in respect to the weight of the reactive material of the gangue.

4. The process for recovering scheelite from scheelite ores according to claim 2, wherein in the alkaline treatment step, after pulp density is adjusted to 20–40% solids, caustic soda is added to the pulp, the pulp is let alone for 5–20 minutes and then is filtered off.

5. The process for recovering scheelite from scheelite ores according to claim 1, wherein in the alkaline treatment step, after pulp density is adjusted to 20–40% solids and caustic soda is added to the pulp, the pulp is let alone for 5–20 minutes at normal temperature, the treated pulp is filtered off.

6. The process according to claim 1, wherein in the flotation step, the fatty acid collector contains oleic acid.

* * * * *